United States Patent [19]

Goedert et al.

[11] Patent Number: 4,524,958

[45] Date of Patent: Jun. 25, 1985

[54] APPARATUS FOR CLOSING THE DISCHARGE APERTURE OF A METALLURGICAL VESSEL

[75] Inventors: Jean Goedert; Fernand Thill; Romain Henrion, all of Esch; Henri Klein, Niedercorn; Jean-François Liesch, Luxembourg; Jean Peckels, Esch, all of Luxembourg

[73] Assignee: Arbed S.A., Luxembourg, Luxembourg

[21] Appl. No.: 509,140

[22] Filed: Jun. 29, 1983

[30] Foreign Application Priority Data

Jun. 29, 1982 [LU] Luxembourg ..... 84237

[51] Int. Cl.[3] ..... C21C 5/46

[52] U.S. Cl. ..... 266/272; 266/45

[58] Field of Search ..... 266/271, 272, 45, 236; 222/597, 601, 602, 604, 605

[56] References Cited

U.S. PATENT DOCUMENTS

| | | | |
|---|---|---|---|
| 3,599,953 | 8/1971 | Smith | 266/272 |
| 4,030,709 | 6/1977 | Shepard et al. | 266/272 |
| 4,201,373 | 5/1980 | Ulveling et al. | 266/271 |
| 4,220,321 | 9/1980 | Brucher | 266/271 |
| 4,298,147 | 11/1981 | Honda et al. | 222/601 |
| 4,399,986 | 8/1983 | Collins | 266/272 |

*Primary Examiner*—L. Dewayne Rutledge
*Assistant Examiner*—S. Kastler
*Attorney, Agent, or Firm*—Fishman & Dionne

[57] ABSTRACT

Apparatus for closing the discharge aperture of a metallurgical vessel is presented. This apparatus includes a closure element attached to a pivoted lever in order to prevent undesirable discharge of slag at the beginning and end of the casting process and during refining. The lever pivotally opens and closes the aperture by means of a piston rod and pressure cylinder. The closure element, preferably made from wood, is temporarily attached to the lever by a friction fit and is designed to be used only once.

16 Claims, 2 Drawing Figures

APPARATUS FOR CLOSING THE DISCHARGE APERTURE OF A METALLURGICAL VESSEL

BACKGROUND OF THE INVENTION

This invention relates to an apparatus for closing the discharge aperture of a metallurgical vessel. More particularly, this invention relates to an apparatus for closing a tilting converter by means of a closure element that is attached to a pivoted lever in order to prevent undesirable discharge of slag at the beginning and end of the casting process and during refining.

It is well known in the art that when a converter is rotated at the beginning of its evacuation process, lower density slag is the first material to enter the discharge aperture before the steel bath has a chance to fully cover the aperture and then flow therethrough. This situation has adverse effects on the service life of the fireproof lining of the pouring ladle since highly oxidized slags are extremely destructive. Moreover, when slag flows out of a carburizing furnace together with or prior to the molten steel, the slag is reduced by the alloying additives. This tends to decrease the yield of alloying additives, draws undesirable phosphorous from the slag into the molten steel and increases the occlusion content phosphorus in the steel.

At the end of the casting cycle and before the converter can be swung back into its original position, some additional slag will again flow with the steel into the ladle. The problem has resulted in the development of various devices including the ceramic ball or plug float. These ceramic balls or plugs have a density between that of the metal and slag and function to obstruct the discharge aperture to prevent slag flow after most of the steel has flowed out. However, since the shape of the discharge aperture is constantly changed by the abrasive and destructive environment of the molten metal, the heavy float method is not particularly reliable for preventing slag/steel mixing.

One solution to the above-described problems is suggested by German Offenlegungschrift No. 2,639,712 which discloses a device wherein a closure element, insertable into the discharge chamber, is provided for closing the discharge aperture of a metallurgical vessel by means of a compressed fitting and compressed gas flow which, during operation, pushes the slag back into the vessel as it is about to be drawn through the aperture with the steel. Argon or nitrogen are examples of compressed gases that may be employed. Because of the hostile environment, this device is subjected to considerable abrasion, especially in large converters.

An improvement to the closing device disclosed in the German patent discussed above has been to construct the outer jacket of the closure element in the shape of a calotte shell that merges on its opening side into a frustrum-shape surface. This improved device is shown in European Patent Application No. 10 082. In a preferred embodiment, the closure element is constructed of cast iron.

It is clear that both of these prior art devices suffer from the disadvantage that large quantities of gas are required in order to seal the discharge aperture. This excess of gas can create numerous problems including premature cooling of the molten steel. Moreover, gas flow must be continuously carried out in order to avoid loading in the mouth of closure element by the molten bath.

SUMMARY OF THE INVENTION

The above-discussed and other related problems of the prior art are reduced or eliminated by the apparatus of the present invention whereby a closing device for a metallugical vessel permits practically slag-free casting with minimal expense.

In accordance with the present invention, a pivoted lever is provided with means for temporarily securing a disposable one-use closure element. The plugs or closure elements are easily fabricated from an inexpensive, relative soft material, preferably wood. The plugs fit the shape of the discharge aperture and therefore form an effective seal without subjecting the adjacent lining of the vessel to high forces. Except when the steel is being drawn off, the discharge aperture is always closed and therefore heat losses and the undesirable passage of molten slag are avoided during the oxygen refining process. Thus, the closing device of the present invention permits virtual slag-free casting due, in part, to the small mass of the closure device and the extremely rapid closure of the discharge aperture.

BRIEF DESCRIPTION OF THE DRAWINGS

Referring now to the drawings, werein like elements are numbered alike in the several FIGS..

DESCRIPTION OF THE PREFERRED EMBODIMENT

Figure 1:
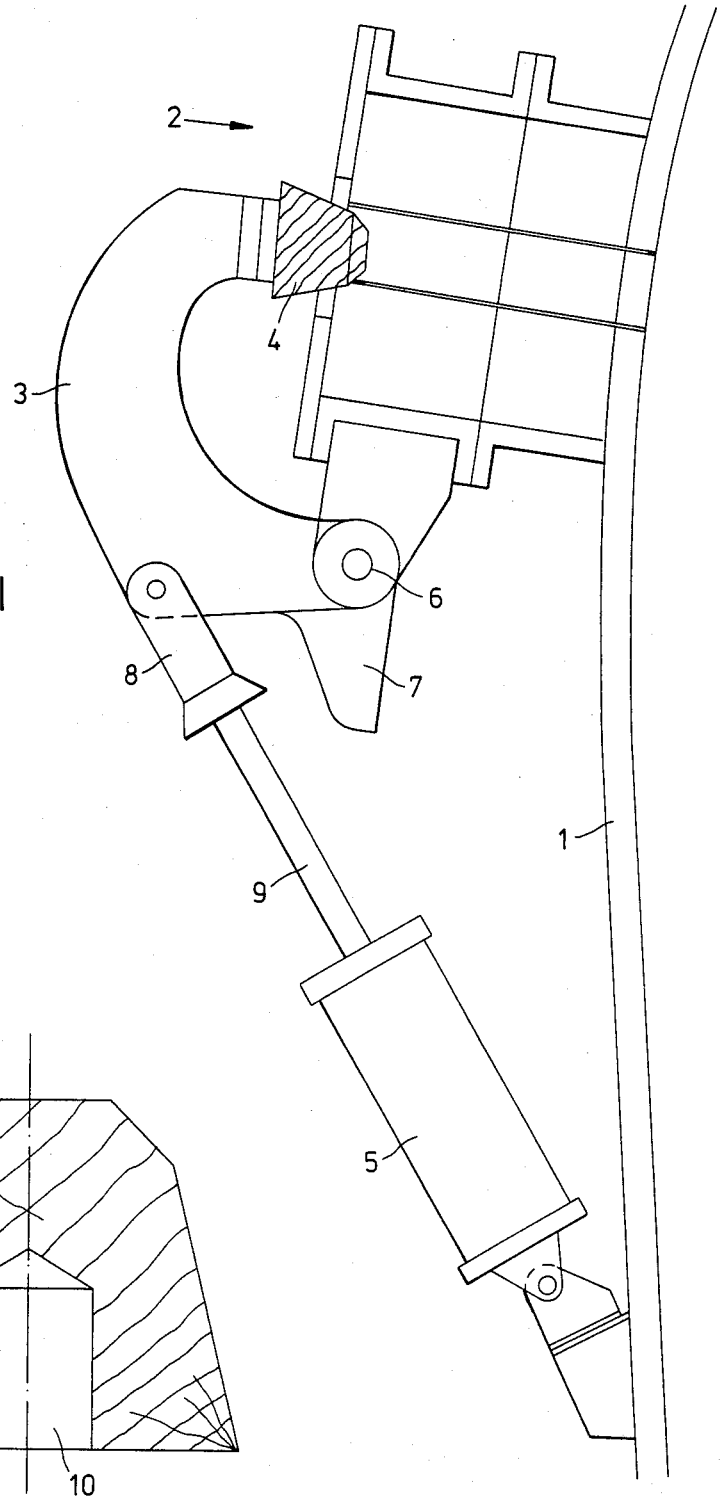
FIG. 1 is an elevational side view, partially in section, of the present invention in the closed position.

Referring now to FIG. 1, the wall 1 is a wall of a converter which will contain molten steel and a slag layer floating thereon. The converter has attached discharge 2 with a central flow aperture provided in wall 1 in the usual manner. In accordance with the present invention, a closure element 4 attached to a lever or swinging arm 3 serves to close the aperture of discharge 2. The lever or swinging arm 3 is supported so that it rotates about a shaft 6 attached to the wall of discharge 2. Arm 3 is also provided with a stop 7. An opposing stop (not shown) may be attached to the wall 1 of the converter vessel. Swinging arm 3 is pivotally connected to a fork 8 attached to a piston rod 9. A double-action pressure cylinder 5, which is pivoted on the outer wall 1 of the converter vessel, moves the swinging arm 3 and closure element 4 from an open position to the closed position shown in FIG. 1.

Figure 2:
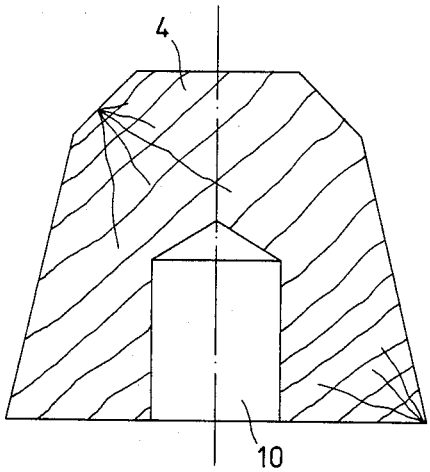
FIG. 2 is an enlarged sectional view of the closure element of FIG. 1.

As shown in FIG. 2, the plug or closure element 4 has the shape of a bevelled conic frustrum. Element 4 is fabricated from wood, preferably spruce or fir. Centrally located in the large base of the frustrum shaped closure element 4, a cylindrical cavity 10 is cut into the wood. The cavity 10 has appropriate dimensions whereby it undergoes a friction fit with a correspondingly dimensioned pin attached to the end of lever or arm 3.

The operation of the closure device of the present invention is as follows: during casting, piston rod 9 is retracted fully into cylinder 5, and a new closure element 4 is placed on the corresponding pin of swinging arm 3, where it is retained by friction. The outer frusto conical surface of closure element 4 is preferably provided with a thin layer of refractory material to increase its resistance to high temperatures. As soon as the first bits of slag are observed or are located by means of optical detecting devices (during the refining process), cylinder 5 is actuated, which immediately and swiftly seats closure element 4 into the central discharge aperture of discharge 2 so as to seal the discharge. Even with the refractory coatings, the relatively soft wooden element 4 conforms to the contours of the discharge aperture, which, as mentioned previously, is constantly changing as a result of abrasion from the molten bath. During the oxygen blowing process the cylinder may be held in the position illustrated in FIG. 1 in order to absolutely insure that the closure element 4 remains in the discharge aperture 2. Shortly before the converter is rotated or tilted for the purpose of emptying it, swinging arm 3 is swung back to stop 7. The tight seal between element 4 and aperture 2 is enough to overcome the friction fit between element 4 and the pin on arm 3 when the arm 3 is swung back to stop 7. Therefore, the closure element 4 is disengaged from arm 3 and remains in the discharge aperture 2. Then, as the converter is tipped, the molten mass enters the discharge aperture and strikes the wooden closure element 4, and, in a few seconds, burns the aperture free. At this point the converter is tipped so far that only metal and no slag is located in the vicinity of the discharge aperture, so only metal flows through the discharge aperture.

The function of the closure element 4 is thus threefold. First, the closure element prevents slag from running out at the start of the casting process; second, it prevents undesirable slag from running out at the end of the casting process (i.e., during pouring) and, third, it keeps the discharge aperture hermetically sealed during the entire refining process. The disposable one-use wooden closure elements are relatively inexpensive compared to the previously discussed prior art devices used in preventing slag from discharging through the aperture.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Closure apparatus for closing the discharge aperture of a metallurgical tilting vessel prior to and subsequent to tilting comprising:

first closure element means suitable for one time use;

second closure element means suitable for one time use;

pivotal lever means having mounting means to temporarily mount said first closure element means at one end thereof, and to temporarily mount said second closure element means at the same end thereof after said first closure element means has been placed in said discharge aperture;

said first and second closure element means having mating means to receive said mounting means; and pressure cylinder means attached by a piston rod to said pivotal lever;

said pivotal lever means being actuated by said pressure cylinder means to seat said first closure element means in said discharge aperture upon actuation of said pressure cylinder means in a first direction prior to tilting, said pivotal lever means being actuated by said pressure cylinder to disengage said first closure element means in said discharge aperture upon actuation of said pressure cylinder means in a second direction, wherein said first closure element means is destroyed when said metallurgical vessel is tilted;

said pivotal lever means being actuated by said pressure cylinder means to seat said second closure element means in said discharge aperture upon actuation of said pressure cylinder means in said first direction subsequent to tilting, said pivotal lever means being actuated by said pressure cylinder to disengage said mounting means from said second closure element means and leave said second closure element means in said discharge aperture upon actuation of said pressure cylinder means in said second direction.

2. The closure apparatus of claim 1 wherein:

said mounting means to temporarily mount one end of said lever to said first and second closure element means comprises a pin.

3. The closure apparatus of claim 2 wherein:

said first and second closure element means are temporarily secured to said pin by a frictional connector.

4. The closure apparatus of claim 2 wherein:

said first and second closure element means have a cavity to receive said pin.

5. The closure apparatus of claim 1 wherein:

said first and second closure element means consists of wood.

6. The closure apparatus of claim 1 wherein:

said first and second closure element means are shaped as a conic frustrum.

7. The closure apparatus of claim 6 wherein:

said conic frustrum shaped first and second closure element means are bevelled on the end having a smaller radius.

8. The closure apparatus of claim 1 including:

a refractory coating on the exterior surface of said first and second closure element means.

9. A method for closing the discharge aperture of a metallurgical tilting vessel prior to and subsequent to tilting utilizing closure apparatus comprising first and second closure element means suitable for one time use, and pivotal lever means having mounting means to temporarily mount the first closure element means at one end thereof and temporarily mount the second closure element means at the same end thereof after said first closure element means has been placed in said discharge aperture, the first and second closure element means having mating means to receive the mounting means, and pressure cylinder means attached by a piston rod to the pivotal lever, the closure method including the steps of:

actuating said pivotal lever means by said pressure cylinder means to seat said first closure element means in said discharge aperture upon actuation of said pressure cylinder means in a first direction prior to tilting;

actuating said pivotal lever means by said pressure cylinder to disengage said mounting means from said first closure element means and leave said first closure element means in said discharge aperture upon actuation of said pressure cylinder means in a second direction, wherein said first closure element means is destroyed when said metallurgical vessel is tilted;

actuating said pivotal lever means by said pressure cylinder means to seat said second closure element means in said discharge aperture upon actuation of said pressure cylinder means in said first direction subsequent to tilting;

actuating said pivotal lever means by said pressure cylinder to disengage said mounting means from said second closure element means and leave said second closure element means in said discharge aperture upon actuation of said pressure cylinder means in said second direction.

10. The closure method of claim 9 wherein:

said mounting means to temporarily mount one end of said lever to said first and second closure element means comprises a pin.

11. The closure method of claim 10 wherein:

said first and second closure element means are temporarily secured to said pin by a frictional conductor.

12. The closure method of claim 10 wherein:

said first and second closure element means have a cavity to receive said pin.

13. The closure method of claim 9 wherein:

said first and second closure element means consists of wood.

14. The closure method of claim 9 wherein:

said first and second closure element means are shaped as a conic frustrum.

15. The closure method of claim 14 wherein:

said conic frustrum shaped first and second closure element means are bevelled on the end having a smaller radius.

16. The closure method of claim 9 including:

a refractory coating on the exterior surface of said first and second closure element means.

* * * * *